United States Patent [19]

Legerius et al.

[11] Patent Number: 4,883,921

[45] Date of Patent: Nov. 28, 1989

[54] CABLE JOINTING CLAMP

[75] Inventors: Bengt E. Legerius; Jan P. R. Tjäderhane, both of Nyköping, Sweden

[73] Assignee: Thorsman & Co. Aktiebolag, Nyköping, Sweden

[21] Appl. No.: 110,758

[22] PCT Filed: Feb. 9, 1987

[86] PCT No.: PCT/SE87/00058

§ 371 Date: Oct. 6, 1987

§ 102(e) Date: Oct. 6, 1987

[87] PCT Pub. No.: WO87/05447

PCT Pub. Date: Sep. 11, 1987

[30] Foreign Application Priority Data

Feb. 27, 1986 [SE] Sweden ..... 8600892.7

[51] Int. Cl.[4] ..... H01R 4/22

[52] U.S. Cl. ..... 174/87; 174/84 S

[58] Field of Search ..... 174/87, 84 S

[56] References Cited

U.S. PATENT DOCUMENTS 2,959,995 11/1960 Linden ..... 174/87
3,056,851 10/1962 Scott ..... 174/87
3,308,229 3/1967 Burniston ..... 174/87
4,163,599 8/1979 Plugge et al. ..... 174/84 S
4,227,040 10/1980 Scott ..... 174/87
4,600,804 7/1986 Howard ..... 174/84 C

FOREIGN PATENT DOCUMENTS 272928 1/1951 Switzerland ..... 174/87

*Primary Examiner*—Morris H. Nimmo
*Attorney, Agent, or Firm*—Roberts, Spiecens & Cohen

[57] ABSTRACT

Jointing clamp (1) intended for electrical conductors and comprising an insulating, conical outer housing (2) having arranged therein a similarly conical inner sleeve (3). The narrow end of the outer sleeve (2) has located internally therein a seat (7) against which a metal ball (6) is locked by the inner sleeve (3) in a manner to fully close the narrow end of the inner sleeve. The outer sleeve (2) is extended with a tubular part (9) which surrounds a through-passing hole (10) in the seat (7) and thus forms a protective tubular device through which access can be had to the metal ball (6) with the aid of a test probe but which will prevent unintentional finger contacts with the ball. This enables electrical measurements to be made safely at joint locations without the need to remove the jointing clamps therefrom.

4 Claims, 1 Drawing Sheet

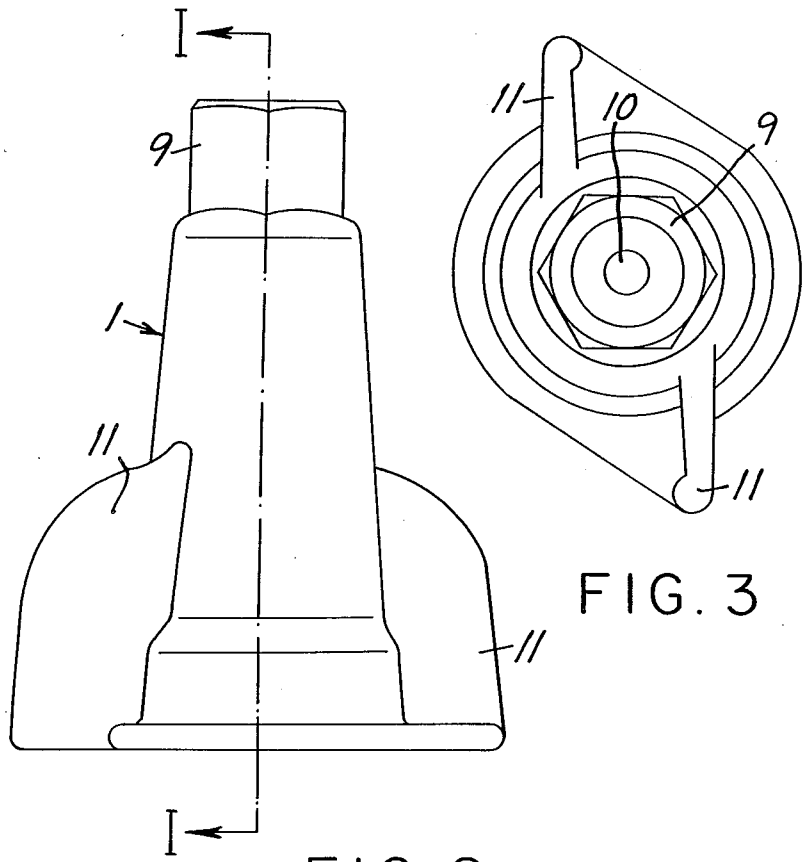
FIG. 3
FIG. 2
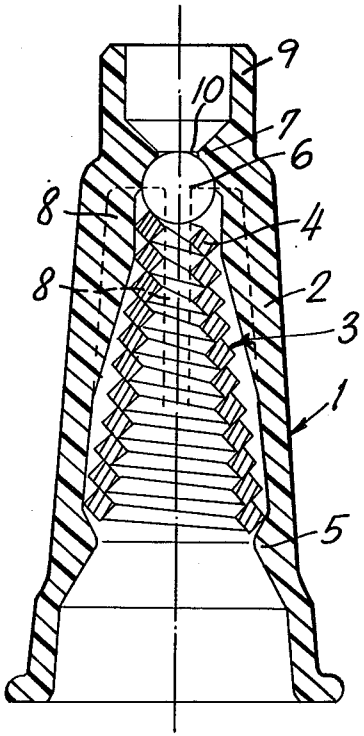
FIG. 1

CABLE JOINTING CLAMP

TECHNICAL FIELD

The present invention relates to a jointing clamp, or cable clamp, intended for joining together electrical cables or conductors and comprising an insulating, conical outer sleeve having arranged therein an electrically conductive, screw-like conical inner sleeve, preferably in the form of a worm spring.

BACKGROUND PRIOR ART

Such jointing clamps are to be found in various forms. In their earliest forms, the outer sleeve of such clamps was made of porcelain and was normally provided with grip-enhancing flutes. The narrow end of the sleeve was closed, and at times had the form of a hexagonal screw-cap. Cable jointing clamps are primarily used to connect together single wires or multi-wire cables in junction boxes or wall terminal boxes of different kinds, either placed in wall or ceiling cavities or surface-mounted. When joining the wires, or conductors, together, the wire-ends are first bared and then spliced or bunched together, whereafter a jointing clamp is placed around the location of the joint and rotated a number of turns, whereupon through the combined agency of the internal screw-thread on the electrically conductive inner sleeve and also its conical configuration, firm electrical contact is established, both directly between the electrical conductors themselves and via the inner sleeve. By shaping the narrow end of the jointing clamp in the form of an hexagon, it was possible to tighten the clamp quickly and reliably, with the aid of a socket wrench or like tool.

At a later stage of development, the outer sleeves of such clamps were made of plastic, which were less bulky than the porcelain sleeves and enhabled the sleeves to be provided with "wings" or lugs in the manner of a wing nut, so as to enable the clamps to be assembled and tightened by hand, without the use of a tool.

However, there were many who considered such hand-assembly of the clamps unsatisfactory and wanting, and consequently tools were developed to fit the wings or lugs on the outer sleeve. These tools, however, resulted in such powerful tightening of the clamps that the ends of some of the wires or conductors in the wire-bunch embraced by the clamp were able to pass through the narrow end of the plastic outer sleeve, such as to represent a safety hazard. This, in turn, initiated the creation of several types of inner sleeves which were of complicated manufacture and the end parts of which were drawn together or otherwise closed, in order to prevent the wires from coming into contact with and passing through the outer sleeve.

At times it is necessary to carry out control checks or to search for faults in joints embraced by such jointing clamps, requiring an instrument or indicator to be connected to the cable joint insulated by the jointing clamp. With present day jointing clamps of this kind, it is necessary to dismantle the clamp by unscrewing the sleeves, carry out the check required and then reassemble the clamp. When this work is carried out a number of times, one or more of the wires in the cable joint are liable to break-off, causing the joint to be re-made.

SUMMARY OF THE INVENTION

An object of the present invention is to provide a cable jointing clamp which when assembled about a cable joint will enable an electrical contact to be established with the joint embraced by the clamp. Another object is to provide a jointing clamp by which the risk of wires in the cable join exiting through the narrow end of the outer sleeve is fully eliminated in a simple manner. A further object is to provide a jointing clamp which in addition to the advantages recited above will not require more space in the junction boxes or wall terminal boxes than conventional cable or wire jointing clamps, and which can be assembled and tightened with the aid of everyday, conventional tools. These objects are achieved by means of a jointing clamp constructed in accordance with the invention and having the features set forth in the following disclosure.

BRIEF DESCRIPTION OF THE DRAWINGS

The invention will now be described in more detail with reference to the accompanying drawings, in which FIG. 1 is a sectional view of a jointing clamp according to the invention;

FIG. 2 is a side view of the clamp shown in FIG. 1; and FIG. 3 is a plan view of said clamp.

DESCRIPTION OF A PREFERRED EMBODIMENT

In the Figures, reference numeral 1 identifies a cable or wire jointing clamp that comprises an electrically insulating, conical outer sleeve 2, preferably made of a plastic material, and an electrically conductive inner sleeve 3 which is arranged within the outer sleeve and which has the form of a worm spring wound from wire 4 of square cross-section with the wire-profile placed on edge, such that the inner sleeve obtains both an outer and an inner screw-thread configuration. The spring-like inner sleeve 3 is held positioned between an internal flange 5 and a metal ball 6 which rests against a seat 7 located at the narrow end of the conical outer sleeve 2. The inner sleeve 3 has a greater conicity than the outer sleeve 2 and consequently the outer sleeve has provided internally thereof guide promontories or camming surfaces 8 which ensure that the two sleeves are centered in relation to one another, such that the ball 6 will fully close the narrow end of the inner sleeve and therewith prevent a wire or like electrical conductor, from penetrating through the narrow end of the inner sleeve and exit through the plastic wall of the outer sleeve when the jointing clamp is in use.

The seat 7 incorporates a through-hole 10 which opens into a tubular extension 9 located adjacent to the narrow end of the outer sleeve 2, this tubular extension being so formed as to enable contact to be made with the ball 6 with the aid of a test probe or the like, said metallic ball 6 in this context functioning as an electrical contact which, in the assembled state of the clamp, is either in direct electric contact with the wiring joint enclosed by the clamp, or in contact with said joint via the inner sleeve 2. The tubular extension 9 prevents finger-contact with the ball 6, or contact therewith through a blunt electrically conductive object or tool thereby reducing the risk of accidents during installation.

As illustrated in FIGS. 2 and 3, the outer sleeve 2 has provided thereon grips or lugs 11 by means of which the jointing clamp can be rotated around a joint or splice location. The tubular extension 9 of the illustrated embodiment has externally the shape of a hexagon, thereby enabling a wrench to be used to effect rotation of the clamp about its longitudinal axis. The extension 9 may also be provided with a hexagonal-shaped recess for engagement with an Allen-key or like insert wrench, to the aforesaid end.

It will be understood that the illustrated and described jointing clamp can be modified within the scope of the inventive concept, and that the combined protective/contact element 6 need not necessarily have the form of a sphere, but may have another suitable configuration. A spherical form, however, affords the best advantages in this context, since when assembling the jointing clamp the ball 6 need only be dropped into the outer sleeve 2 and will find its own position, whereas a corresponding element of different configuration would have to be placed in position.

In order to establish good contact between inner sleeve 3 and contact element 6, it is important that the inner sleeve 3 presses firmly against the contact element 6. When the inner sleeve 3 consists of a worm spring, as in the present case, this can readily be achieved by winding all or some of the spring turns loosely, such that the various spring turns will not come into contact with one another until the helically wound inner sleeve 3 is pressed into place in the outer sleeve 2.

What is claimed is:

1. A jointing clamp for connecting together electrical conductors, comprising an insulating, conical outer sleeve having opposite wide and narrow ends, an electrically conductive, screw-like conical inner sleeve arranged within the outer sleeve and having the form of a worm spring, an electric contact element locked against a seat arranged internally of the narrow end of the conical outer sleeve for sealing said narrow end of said sleeve; said seat being provided therein with a hole which is open towards a tubular extension located adjacent to the narrow end of the outer sleeve and which is formed so as to enable a test probe to establish contact with the contact element and therewith, via the inner sleeve, also with the electrical conductors to be connected by the jointing clamp, said electric contact element comprising a ball, said seat being rounded, said ball being pressed against said seat by said worm spring to close said hole, said tubular extension providing an opening for the test probe, said opening being convergent in proximity to said ball.

2. A jointing clamp as claimed in claim 1 wherein said tubular extension and said opening therein are so formed to prevent unintentional finger contact with the ball.

3. A jointing clamp as claimed in claim 1 wherein said ball is metal.

4. A jointing clamp as claimed in claim 1 wherein said conical inner sleeve has greater conicity than the conical outer sleeve, said inner sleeve including internal camming surfaces for centering the inner and outer sleeves so that said ball closes said hole.

* * * * *